US005518666A

United States Patent [19]

Plester et al.

[11] Patent Number: 5,518,666

[45] Date of Patent: May 21, 1996

[54] DEVICE AND METHOD FOR TEMPERATURE-REGULATION OF A GAS-LIQUID ABSORPTION SYSTEM PARTICULARLY $CO_2$ WATER ABSORPTION

[75] Inventors: George Plester; Stijn Vandekerckhove, both of Brussels, Belgium

[73] Assignee: The Coca-Cola Company, Atlanta, Ga.

[21] Appl. No.: 310,060

[22] Filed: Sep. 21, 1994

[51] Int. Cl.[6] ..... B01F 3/04

[52] U.S. Cl. ..... 261/39.1; 261/64.3; 261/DIG. 7

[58] Field of Search ..... 261/DIG. 7, 39.1, 261/64.3

[56] References Cited

U.S. PATENT DOCUMENTS

| | | | |
|---|---|---|---|
| 2,199,661 | 5/1940 | Gamble et al. . | |
| 2,371,431 | 3/1945 | DiPietro . | |
| 2,391,003 | 12/1945 | Bowman | 261/DIG. 7 |
| 2,543,978 | 3/1951 | Matthiesen . | |
| 2,606,749 | 8/1952 | Bayers, Jr. | 261/DIG. 7 |
| 3,054,273 | 9/1962 | McGrath . | |
| 3,335,952 | 8/1967 | Yingst et al. . | |
| 3,877,637 | 4/1975 | Motoyama . | |
| 4,148,334 | 4/1979 | Richards | 261/DIG. 7 |
| 4,463,897 | 8/1984 | Denneny, Jr. et al. . | |
| 4,517,135 | 5/1985 | Szerenyi et al. | 261/DIG. 7 |
| 4,818,444 | 4/1989 | Hedderick et al. . | |
| 4,869,396 | 9/1989 | Horino et al. | 261/DIG. 7 |
| 4,874,116 | 10/1989 | Fallon et al. | 261/DIG. 7 |
| 5,056,681 | 10/1991 | Howes . | |
| 5,178,799 | 1/1993 | Brown et al. . | |

FOREIGN PATENT DOCUMENTS

| | | |
|---|---|---|
| 2490311 | 3/1982 | France . |
| 2541663 | 8/1984 | France . |
| 2653421 | 4/1991 | France . |
| 2671268 | 10/1992 | France . |
| 2684088 | 5/1993 | France . |
| 429299 | 7/1985 | Germany . |

*Primary Examiner*—Tim R. Miles

*Attorney, Agent, or Firm*—Birch, Stewart, Kolasch & Birch

[57] ABSTRACT

In an apparatus and method for maintaining a desired (target) carbonation level in a carbonator, a control-signal originates from a reference standard of carbonated water close to the target carbonation level, which is sealed inside a pilot chamber of the regulator. The pilot chamber is exposed to the water temperature in the carbonator and is shaped and sized so as to promote rapid equalization of the temperature of the reference standard with that of the carbonated water. The pressure inside the pilot chamber is equal to the equilibrium vapor pressure, according to the temperature and carbonation level of the reference standard. This pressure is transmitted through a flexible membrane in one of the walls of the pilot chamber to a valve in the gas-supply line of the carbonator. This valve, therefore, balances the $CO_2$ gas pressure within the carbonator with the equilibrium vapor pressure in the pilot chamber. Since the equilibrium vapor pressure in the pilot chamber is precisely equivalent to the saturated concentration of the reference standard at the prevailing temperature, the adjustment of the carbonator pressure to this equilibrium pressure results in a constant carbonation-driving force.

22 Claims, 2 Drawing Sheets

DEVICE AND METHOD FOR TEMPERATURE-REGULATION OF A GAS-LIQUID ABSORPTION SYSTEM PARTICULARLY $CO_2$ WATER ABSORPTION

BACKGROUND OF THE INVENTION

The present invention relates to a method and apparatus for maintaining a desired gas-liquid absorption level in a liquid irrespective of changes of temperature of the liquid. More specifically, the present invention relates to a method and apparatus for controlling the pressure of $CO_2$ gas supplied to a carbonator in order to maintain a desired carbonation level of the carbonated liquid therein, despite changes in temperature of the carbonated liquid.

Carbonators produce carbonated water of predetermined (target) carbonation levels, by absorbing $CO_2$ in water. The driving force for mass-transfer in the absorption process is equal to the difference between the saturated concentration of $CO_2$ in water and the target carbonation level. Since other mass-transfer conditions within the carbonator, such as contact surface and agitation are normally fixed, the target carbonation will be maintained provided that this driving force for mass-transfer is kept constant. However, the saturated concentration of $CO_2$ in water is dependent on pressure and temperature, according to Henry's law. As a consequence, when the water temperature varies, the resulting change in mass-transfer driving force will cause a change in the level of final carbonation and the target carbonation level will thus not be maintained. For example, when the temperature of water in the carbonator increases, it is necessary to increase the pressure of carbon dioxide supplied to the carbonator in order to maintain a given carbonation level. For this reason, carbonators are usually designed to operate within a very narrow water temperature range and the $CO_2$ pressure is fixed to that the target carbonation level is attained within this temperature range.

In order to achieve the target carbonation level, regardless of the prevailing water temperature in the carbonator, the $CO_2$ gas pressure must be varied with water temperature, ideally so as to produce a constant driving force (i.e. a constant difference between saturated concentration and target concentration). Simply changing gas pressure in relation to water temperature is not reliable, since this does not have a linear relationship to mass-transfer driving force, as illustrated by FIG. 1. No simple, direct-acting device exists either for controlling carbonator gas pressure according to water temperature, or more particularly, for controlling mass-transfer driving force according to water temperature.

SUMMARY OF THE INVENTION

A primary objective of the present invention is to provide a simple, direct-acting regulator, which automatically either compensates the $CO_2$ gas pressure in a carbonator for changes in water temperature, or, more particularly, which compensates the carbonation mass-transfer driving force according to water temperature.

It is another object of the present invention to provide a method and apparatus for maintaining a desired gas-liquid absorption level in a liquid irrespective of changes of temperature of the liquid.

It is another object of the present invention to provide a carbonation level regulator construction which is compact and inexpensive including a few injection molded or stamped metal parts.

The objects of the present invention are fulfilled by providing apparatus for maintaining a desired gas-absorption level of gas in a liquid comprising:

means for providing a reference quantity of the same liquid with a desired gas-absorption level;

means for sensing vapor pressure of the reference quantity of liquid; and means for controlling the gas-absorption level as a function of the vapor pressure sensed;

whereby a constant mass-transfer driving force between gas and liquid is maintained irrespective of the temperature of the liquid.

In a preferred embodiment a control-signal originates from a reference standard of carbonated water close to the target carbonation level, which is sealed inside a pilot chamber. The pilot chamber is exposed to the water temperature in the carbonator system, and is shaped and sized so as to promote rapid equalization of the temperature of the reference standard with that of the carbonator water. The pressure inside the pilot chamber is equal to the equilibrium vapour pressure, according to temperature and carbonation level of the reference standard. This pressure is transmitted through a flexible membrane in one of the walls of the pilot chamber to a valve in the gas-supply line of the carbonator. This valve therefore balances the $CO_2$ gas pressure within the carbonator with the equilibrium vapour pressure in the pilot chamber. Since the equilibrium vapour pressure in the pilot chamber is precisely equivalent to the saturated concentration of the reference standard at the prevailing temperature, the adjustment of the carbonator pressure to this equilibrium pressure results in constant carbonation driving force.

Further scope of applicability of the present invention will become apparent from the detailed description given hereinafter. However, it should be understood that the detailed description and specific examples, while indicating perferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1A:
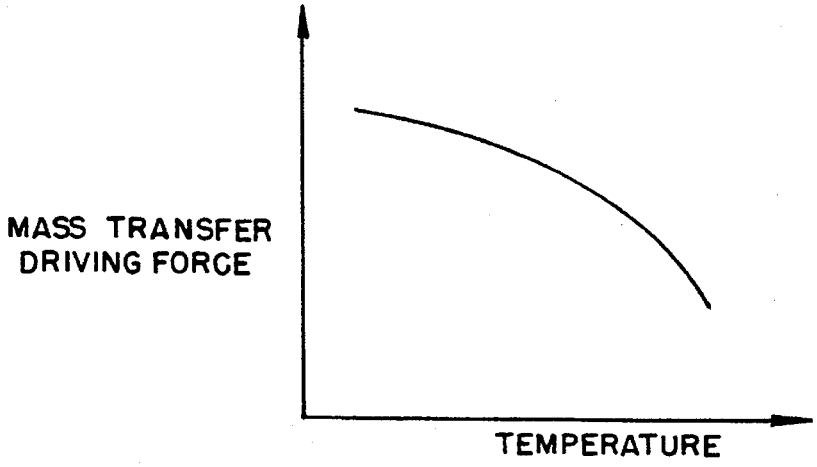
FIG. 1A is a graph illustrating the non-linear relationship between mass transfer driving force and temperature in a gas-liquid absorption system.
Figure 1B:
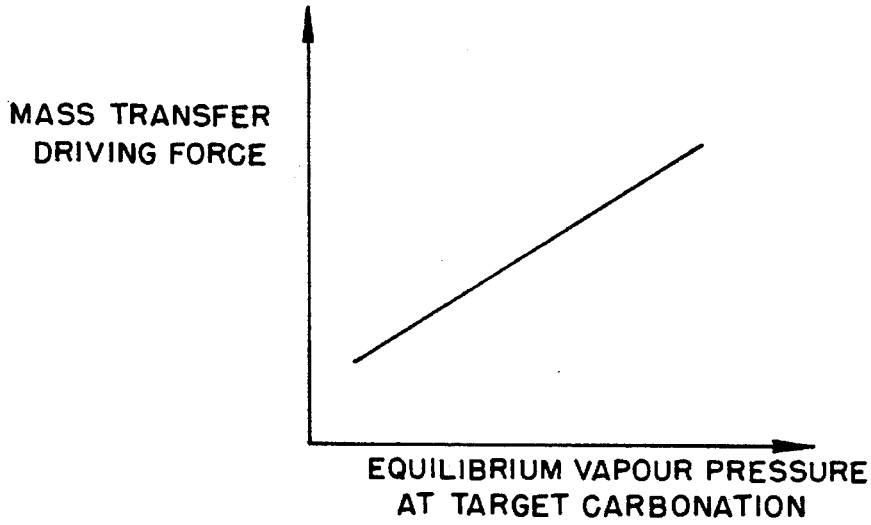
FIG. 1B is a graph illustrating the linear relationship between mass-transfer driving force and equilibrium vapor pressure at target carbonation in the carbonation system of the present invention.
Figure 2:
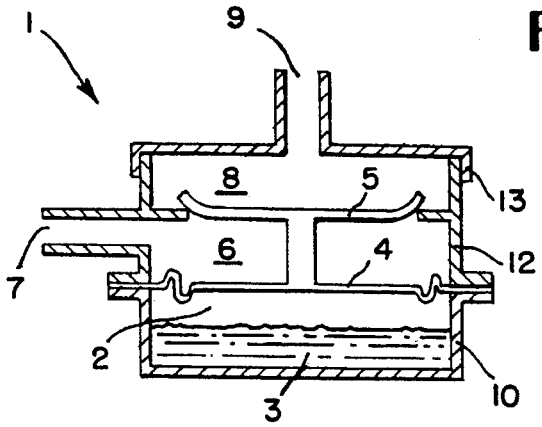
FIG. 2 is a cross-sectional view of one embodiment of the pilot chamber and associated regulation valve of the present invention.

FIG. 2 demonstrates one embodiment and the main principles of this invention.

Figure 3A:
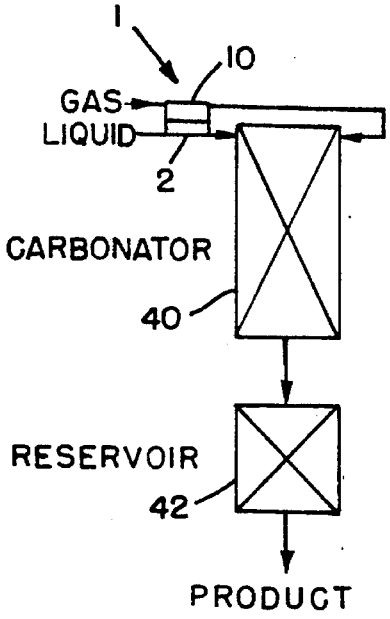
FIG. 3A is a diagrammatic view illustrating the pilot chamber/regulator valve of FIG. 2 in the water supply line of the carbonator.
Figure 3B:
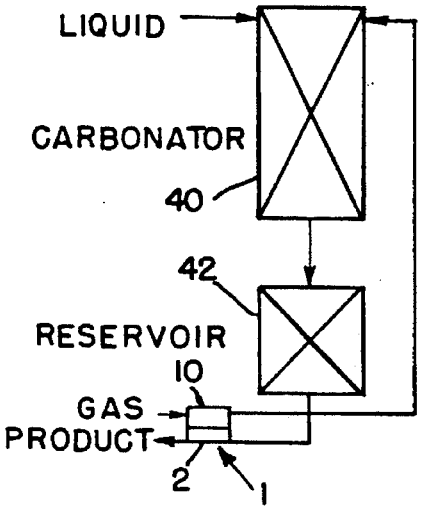
FIG. 3B is a diagrammatic view illustrating the pilot chamber/regulator valve of FIG. 2 in the carbonated product output line of the carbonator.
Figure 3C:
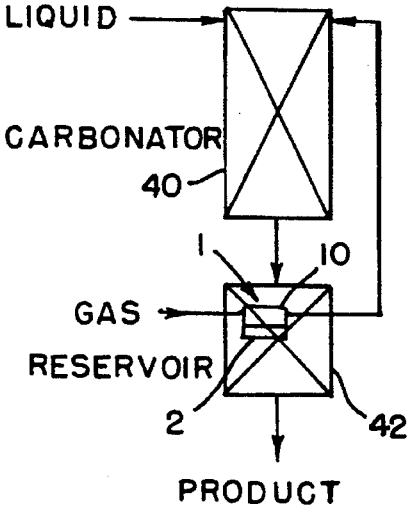
FIG. 3C is a diagrammatic view illustrating the pilot chamber/regulator valve of FIG. 2 in a water reservoir coupled to the output product line of the carbonator.
Figure 3D:
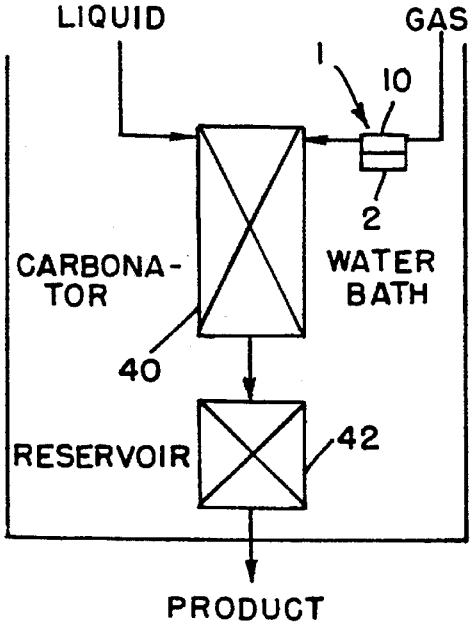
FIG. 3D is a diagrammatic view illustrating the pilot chamber/regulator valve of FIG. 2 immersed in a water bath with the carbonator.

A regulator (1) with a pilot chamber (2) is partially filled with a reference quantity of carbonated water (3) and sealed by a flexible membrane (4). The pressure in the pilot chamber (2) is therefore equal to the equilibrium vapour pressure of the carbonated water (3) at the prevailing temperature. The container (10) of the pilot chamber (2) is thermally-conducting and in contact with the water temperature in the carbonator so that the temperature of the reference quantity of the carbonated water (3) changes to reflect the temperature of the water in the carbonator (40). To this end, the container (10) of the pilot chamber (2) is inserted into the water-supply line of the carbonator, as illustrated by FIG. 3A; or into the carbonator product line as in FIG. 3B. If the carbonator has an external carbonated water reservoir (42) the entire regulator (1) can be submerged in this reservoir as shown in FIG. 3C. When the entire carbonator is placed in a water bath, the regulator (1) can also be submerged in this water bath (FIG. 3D). In each of the four cases in FIG. 3, the pilot chamber (2) and the reference standard of carbonated water inside (3) are kept at the temperature of the water within the carbonator (40).

In order to minimize response time to water temperature variations, the container (10) must have a large external contact surface area and also enable rapid absorption/desorption of $CO_2$ within the carbonated water (3), so that the vapour pressure in the pilot chamber (2) quickly attains the pressure level which is at equilibrium with the carbonated water temperature. In this embodiment, these two criteria are achieved by a pilot chamber (2), which is wide and shallow. This provides a large external area for temperature equalization and, when filled with a very shallow reference quantity of carbonated water (3), provides a large liquid surface area for rapid attainment of equilibrium vapour pressure at the prevailing temperature. Also, the container (10) is preferably made of thin sheet metal in order to improve heat transfer through the chamber walls and has a minimum of free gas space, when filled, so as to accelerate pressure response.

The pressure inside the pilot chamber (2) acts upon the flexible membrane (4), which is rigidly connected to a valve (5). The membrane (4) and the valve (5) have the same exposed surface area in contact with the gas in the high-pressure chamber (6) and the vapour pressure in pilot chamber (2). Valve (5) regulates the pressure between the high-pressure chamber (6), which is connected to the $CO_2$ supply by the inlet (7), and the low-pressure chamber (8), which is connected to the carbonator by the outlet (9). The $CO_2$ supply in the high-pressure chamber exerts its pressure upon the valve (5) as well as upon the membrane (4). As both have the same surface area in contact with the gas in the high-pressure chamber (6), the forces acting on each as a result of the supply pressure are in balance, and do not influence the position of the valve (5). The pressure in the low-pressure chamber (8), which is always equal to the $CO_2$ gas pressure within the carbonator, is therefore balanced by the vapour pressure in the pilot chamber (2). When the pressure in the low-pressure chamber (8) is reduced due to absorption of gas inside the carbonator, the forces across the valve (5) are unbalanced and the valve (5) will open, allowing more $CO_2$ gas to flow from inlet (7), through the valve (5) to outlet (9) and to the carbonator. As soon as the carbonator pressure has become equal to the pressure in the pilot chamber (2), the force balance across the valve (5) is restored and the valve (5) will close. The carbonator pressure will thus always be equal to the equilibrium vapour pressure of the carbonated water (3) which acts as a reference standard, so that the mass-transfer driving force in the carbonator is always kept constant and a constant level of carbonation is achieved in the product streams output from the carbonator.

The embodiment in FIG. 2 can be manufactured from a minimum of parts: principally a container (10), a valve (5), a membrane (4), a valve seat housing (12), and a lid (13). The container (10) and the membrane (4) are metal parts to provide good heat transfer and avoid gas permeation, but the other parts are preferably injection moulded plastic parts to enable low-cost mass production. Upon assembly, the valve (5) is inserted into its seat (12) and the membrane (4) is attached to the valve seat housing (12), together with the lid (13). The pilot chamber (2) is filled with either chilled carbonated water, or ice and solid $CO_2$ in the correct proportion, and then sealed immediately by welding it to the membrane (4).

The proportions of water and $CO_2$ filled into container (10) predetermine the mass-transfer driving force provided by the regulator (1) within the carbonator. Preferably the ratio of depths of liquid to gas in container 10 is about 1:1 in a range of 2 to 5 mm. The diameter of cylindrical container 10 which defines the surface area of the liquid/gas interface is 5 to 100 mm depending on the application and preferably 20 to 25 mm.

Striction induced by the natural stiffness of parts within the regulator (1) can be overcome by adjusting the carbonation level of the carbonated water (3). Therefore, adjustable components to bias the regulator (1) are not required, since the manufacturing tolerances of the simple moulded/stamped component parts can be kept within the tolerance limits.

A reference standard of plain $CO_2$ only can also be used instead of carbonated water within the regulator (1), in applications where less accuracy is acceptable. A reference standard of $CO_2$ can be prepared by simply filling a weighed quantity of solid $CO_2$ into the reference chamber and sealing it immediately.

Figure 4:
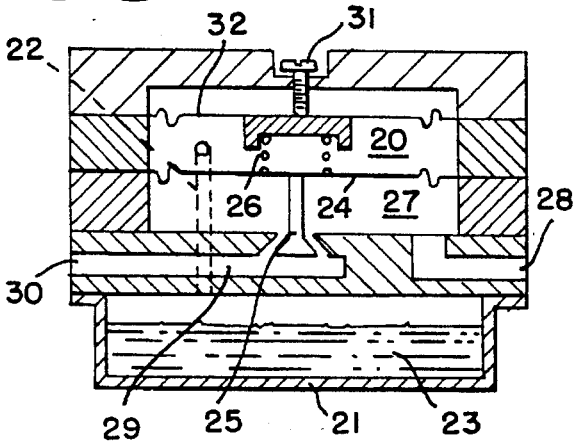
FIG. 4 is another embodiment of a pilot chamber/regulator valve configuration of the present invention.

An alternative embodiment, based on conventional production engineering methods, using metal components, is shown in FIG. 4. The pilot chamber (20) is connected over a narrow channel (22) to the reference standard chamber (21). This is partially filled, in the manner already described, with a reference standard (23) of carbonated water and is exposed to the water temperature in the carbonator system, as in FIGS. 3A to 3D. In the reference standard chamber (21) and the pilot chamber (20), an equilibrium vapour pressure is established, according to temperature and carbonation of the reference standard (23). This pressure acts upon a flexible membrane (24), which constitutes one of the pilot chamber (20) walls and is connected to the valve pin (25). Enclosed in the pilot chamber is a spring (26), which exerts a biasing force upon the membrane (24). The pressure in the low-pressure chamber (27), at the opposite side of the membrane, is always equal to the carbonator pressure, as this chamber is directly connected with the carbonator by the regulator outlet (28). When the force exerted on the membrane (24) by the pressure in the low-pressure chamber (27) is lower than the force exerted by pressure in the pilot chamber (20) plus the spring (26) force, valve (25) will be opened. Gas will then enter the high-pressure chamber (29) via inlet (30) and flow through the valve (25) to low-pressure chamber (27) and to the carbonator via outlet (28). Because of the inflow of gas, the pressure in the carbonator, and thus in chamber (27), will rise until the forces on membrane (24) are balanced, as a result of which the valve (25) will close again.

The biasing force of spring (26) can be set with bias screw (31). Membrane (32) allows compression of the spring (26), whilst the pilot chamber (20) remains sealed.

Whilst the concept described above related to the specific absorption process of carbonating water, a similar principle can be applied to any gas/liquid absorption system.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Apparatus for controlling the pressure of $CO_2$ gas supplied to a carbonator in order to maintain a desired carbonation level of the carbonated liquid therein despite changes in temperature of the carbonated liquid comprising:

a. conduit means for supplying $CO_2$ gas to the carbonator;

b. valve means in said conduit means for controlling the pressure of $CO_2$ gas supplied to the carbonator;

c. a pilot chamber in fluid communication with a reference quantity of carbonated liquid at the desired carbonation level;

d. valve actuator means in fluid communication with both the $CO_2$ gas in the conduit means and vapour associated with the carbonated liquid in the pilot chamber for actuating said valve means in response to pressure differences between the $CO_2$ gas and the vapour pressure of the reference quantity of carbonated liquid; and e. temperature control means for maintaining the temperature of the reference quantity of carbonated liquid at substantially the same level as the temperature of the carbonated liquid in the carbonator.

2. The apparatus of claim 1 wherein said valve actuator means comprises a diaphragm with one side thereof in fluid communication with the $CO_2$ gas and the other side thereof in fluid communication with vapour associated with the reference quantity of carbonated liquid, said diaphragm being connected to said valve means.

3. The apparatus of claim 1 wherein said temperature control means comprises thermal coupling means thermally connecting the carbonated liquid in the carbonator and the reference quantity thereof.

4. The apparatus of claim 3 wherein the thermal coupling means comprises a heat transfer connection between the reference quantity and a wall of the carbonator.

5. The apparatus of claim 3 wherein the thermal coupling means comprises a water bath and the carbonator and reference quantity are both immersed in the water bath.

6. The apparatus of claim 3 wherein the thermal coupling means comprises a heat transfer connection between the reference quantity and water input to the carbonator.

7. The apparatus of claim 3 wherein said pilot chamber contains said reference quantity, is dimensioned to keep vapor space therein to a minimum, and has a large free reference liquid surface of the reference quantity of carbonated liquid in comparison with the volume thereof.

8. The apparatus of claim 3 wherein the thermal coupling means comprises a heat transfer connection between the reference quantity and carbonated liquid output from the carbonator.

9. The apparatus of claim 5 wherein the thermal coupling means comprises a reservoir tank for holding carbonated liquid output from the carbonator, and the reference quantity is self-contained but immersed in the carbonated liquid therein.

10. The apparatus of claim 3 wherein the reference quantity is disposed in the pilot chamber and the pilot chamber has relatively large external thermally conductive surfaces in proportion to the pilot chamber volume.

11. The apparatus of claim 10 wherein said pilot chamber contains said reference quantity, is dimensioned to keep vapor space therein to a minimum, and has a large free reference liquid surface of the reference quantity of carbonated liquid in comparison with the volume thereof.

12. A method for maintaining a desired carbonating level of a carbonated liquid in a carbonator comprising the steps of:

a. providing a reference quantity of carbonated liquid;

b. sensing vapor pressure of the reference quantity of carbonated liquid;

c. controlling the carbonation pressure in the carbonator as a function of the vapor pressure sensed; and d. maintaining the temperature of the reference quantity of carbonated liquid at substantially the same level as the carbonated liquid in the carbonator;

whereby a constant mass-transfer driving force between $CO_2$ gas and liquid in the carbonator is maintained irrespective of the temperature of carbonated liquid in the carbonator.

13. Apparatus for maintaining a desired carbonation level of a carbonated liquid in a carbonator comprising:

a. means for providing a reference quantity of carbonated liquid;

b. means for sensing vapor pressure of the reference quantity of carbonated liquid;

c. means for controlling the carbonation pressure in the carbonator as a function of the vapor pressure sensed; and d. means for maintaining the temperature of the reference quantity of carbonated liquid at substantially the same level as the carbonated liquid in the carbonator;

whereby a constant mass-transfer driving force between $CO_2$ gas and liquid in the carbonator is maintained irrespective of the temperature of carbonated liquid in the carbonator.

14. A method for maintaining a desired gas-absorption level of gas in a liquid comprising the steps of;

a. providing a reference quantity of the same liquid with a desired gas-absorption level;

b. sensing vapor pressure of the reference quantity of liquid;

c. controlling the gas-absorption level in the liquid as a function of the vapor pressure sensed; and d. maintaining the temperature of the reference quantity of liquid at substantially the same level as the liquid;

whereby a constant mass-transfer driving force between gas and liquid is maintained irrespective of the temperature of the liquid.

15. Apparatus for maintaining a desired gas-absorption level of gas in a liquid comprising:

a. means for providing a reference quantity of the same liquid with a desired gas-absorption level;

b. means for sensing vapor pressure of the reference quantity of liquid;

c. means for controlling the gas-absorption level as a function of the vapor pressure sensed; and d. means for maintaining the temperature of the reference quantity of liquid at substantially the same level as the liquid;

whereby a constant mass-transfer driving force between gas and liquid is maintained irrespective of the temperature of the liquid.

16. A regulator for use in a $CO_2$ gas supply line to a carbonator for maintaining a desired carbonation level of carbonated liquid in the carbonator despite changes in temperature of the carbonated liquid comprising;

a housing having a fluid inlet connectable to the $CO_2$ gas supply line and a fluid outlet connectable to a fluid inlet of the carbonator;

a sealed chamber in the housing;

a reference quantity of carbonated liquid within said sealed chamber;

diaphragm means within said housing having a first side in fluid communication with vapour associated with the reference quantity and an opposite side in fluid communication with the fluid outlet of the housing;

a valve disposed between the fluid inlet and outlets of the housing, said valve being coupled to said diaphragm means and moveable thereby and;

heat transfer means associated with said sealed chamber connected to a fluid having a temperature representative of the temperature in the carbonated liquid in the carbonator.

17. The regulator of claim 16 wherein said diaphragm means comprises a flexible wall of the sealed chamber.

18. The regulator of claim 16 wherein said sealed chamber is fabricated from heat conducting metal forming the heat transfer means, and remaining components of said regulator being fabricated from plastic.

19. The regulator of claim 16 wherein the diaphragm means comprises two-spaced diaphragms and is separated from the sealed chamber and connected by a conduit to the interior of the sealed chamber, the space between the diaphragms forming a pilot chamber for vapour associated with the reference quantity of carbonated liquid.

20. The regulator of claim 19 wherein said sealed chamber is fabricated from heat conducting metal forming the heat transfer means, and the remaining components of said regular being fabricated from plastic.

21. The regulator of claim 19 further including means for manually adjusting the force that the diaphragm means may exert on the valve.

22. The regulator of claim 21 wherein said sealed chamber is fabricated from heat conducting metal forming the heat transfer means, and the remaining components of said regular being fabricated from plastic.

* * * * *